US005590783A

United States Patent [19]

Capy et al.

[11] Patent Number: 5,590,783

[45] Date of Patent: Jan. 7, 1997

[54] DEVICE COMBINING A DISPOSABLE NAPKIN WITH A FAST FOOD CONTAINER, AND METHOD FOR CONTINUOUSLY PRODUCING SAME

[76] Inventors: Gilbert Capy, La Botte 69640, Jarnioux, France; Akiva Buchberg, 5030 Pine Tree Dr., Miami Beach, Fla. 33140

[21] Appl. No.: 522,295

[22] PCT Filed: Mar. 15, 1994

[86] PCT No.: PCT/FR94/00274

§ 371 Date: Sep. 13, 1995

§ 102(e) Date: Sep. 13, 1995

[87] PCT Pub. No.: WO94/21529

PCT Pub. Date: Sep. 29, 1994

[30] Foreign Application Priority Data

Mar. 16, 1993 [FR] France ..... 93 03241

[51] Int. Cl.[6] ..... B65D 75/04; B65D 85/72

[52] U.S. Cl. ..... 206/542; 206/216; 206/494; 229/87.03; 229/904; 426/112

[58] Field of Search ..... 206/216, 217, 206/494, 541, 542; 229/87.03, 902, 904, 938; 426/112

[56] References Cited

U.S. PATENT DOCUMENTS

| | | | |
|---|---|---|---|
| 3,407,927 | 10/1968 | Jones . | |
| 3,499,538 | 3/1970 | Sherard | 211/13 |
| 5,131,586 | 7/1992 | Capy | 229/87.03 |
| 5,364,016 | 11/1994 | Capy et al. | 229/87.03 |

FOREIGN PATENT DOCUMENTS

| | | |
|---|---|---|
| 2676037 | 11/1992 | France . |
| 8630396 | 5/1987 | Germany . |

*Primary Examiner*—Jimmy G. Foster
*Attorney, Agent, or Firm*—Kane, Dalsimer, Sullivan, Kurucz, Levy, Eisele and Richard, LLP

[57] ABSTRACT

A napkin (25) combined with a fast food container is placed on the plane portion (14) of the container and held in place by a sheet (18) which covers all or part of the napkin (25) and which extends beyond the napkin (25) at points permitting its attachment to the portion (14) of the container. This assembly constitutes the plane portion (32) of the container; when the container is being used, the napkin (25) stays in place until the consumer removes it from its housing consisting of the sheets (14) and (18) before eating. This concept is applicable to various existing containers.

5 Claims, 5 Drawing Sheets

DEVICE COMBINING A DISPOSABLE NAPKIN WITH A FAST FOOD CONTAINER, AND METHOD FOR CONTINUOUSLY PRODUCING SAME

The invention relates to a device making it possible to combine a folded container, used for packaging the food products sold in the fast food trade, with a disposable napkin.

The fast food trade, which in particular sells sandwiches containing meat, and loose products such as chips, is actively looking at all the means permitting a reduction in the consumption of basic materials used either for packaging its products or for purposes of wiping oneself clean. It has been noted in particular that the present structure of the containers obliges the restaurant chains to offer disposable paper napkins on a self-service basis; it is often observed that consumers take bundles of napkins which are out of all proportion to their need for protection in connection with eating their food; this results in a great deal of waste of basic materials, which waste it is essential to avoid without thereby inconveniencing the consumer.

It is well known that the traditional containers do not allow sandwiches in particular to be eaten without running the risk of getting sauce on one's clothes; a range of containers are being developed at present which are made from folded paper and are described in the patents FR-A-2676037, FR-A 2681582, FR-A-2689105, FR-A-2692867, which containers make it possible to eat in particular hamburgers, and chips or similar products served in loose form, minimizing the risk of one's getting dirty, and without the container spilling its contents onto the surface on which it is placed. The use of these containers makes for more convenient eating, permitting a saving in terms of napkins, but this rate of consumption is declining slowly on account of the bad habits acquired by the consumers; hence the idea of combining the napkin with the container used for packaging the sandwich or the bag of chips. Under these conditions, the rate of consumption of napkins is directly associated with the sale of the product, and it is no longer necessary to provide napkins at distribution outlets.

The description of the invention which is given below will be better understood with the help of the attached drawings, in which.

Figure 1:
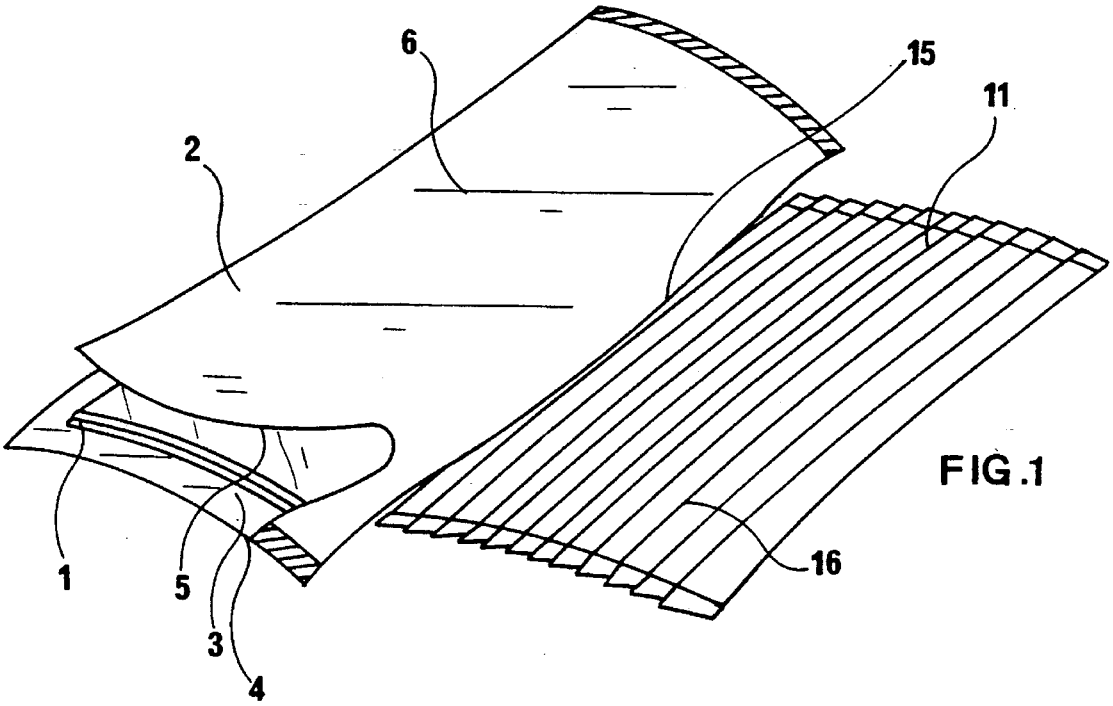
FIG. 1 shows, in a partially exploded perspective view, a container for a sandwich, comprising a napkin according to the invention.

The device according to the invention, as shown in FIG. 1, consists of the combination of a napkin 1 and a container 2, the napkin 1 being positioned between the actual container 2 and a thin sheet 3 fixed to the container; the containers described in the abovementioned patents are taken as examples, but it will be understood that this concept is applicable to all existing containers based on paper or cardboard, including those comprising a single plane sheet or a bag made of ordinary paper; it is also understood that the napkin can be replaced by another flat, thin and flexible, or possibly semi-rigid, article such as a voucher, or a cardboard reinforcement, in order to prevent the hamburger being crushed, and which may also co-exist with the napkin; the thin sheet 3 is fixed to the container about all or part of its perimeter 4 in order to create a pocket 5 in which the napkin 1 is situated; the pocket 5 is positioned in such a way that its function is not disrupted by the use of the container 2, at least not until the product is given to the consumer.

Figure 2:
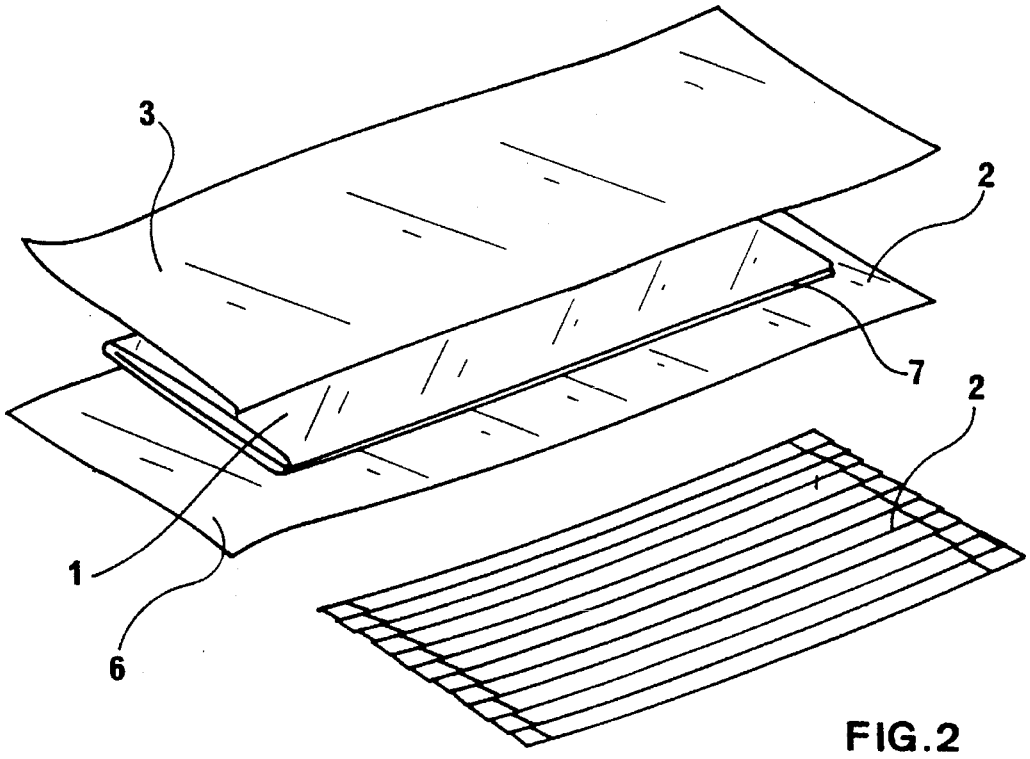
FIG. 2 shows the various components of the container in FIG. 1 prior to their assembly.

When the container 2 (FIG. 2) comprises a thin sheet 6 having a plane portion with a surface area which is sufficient to permit to be placed thereon a normally folded paper napkin 1, comprising, for example, a maximum of 10 superposed thicknesses of paper once the napkin is folded, it suffices to cover that zone of the plane sheet 6 supporting the napkin 1 with a thin sheet 3 whose surface area is such that it extends beyond the napkin 1 over all or part of its perimeter 7, so as to be able to fix it on the plane portion 6 supporting the napkin 1. The mode of fixing the thin sheet 3 on the plane portion 6 supporting the napkin 1 can be by gluing or welding or by any other means known.

Figure 3:
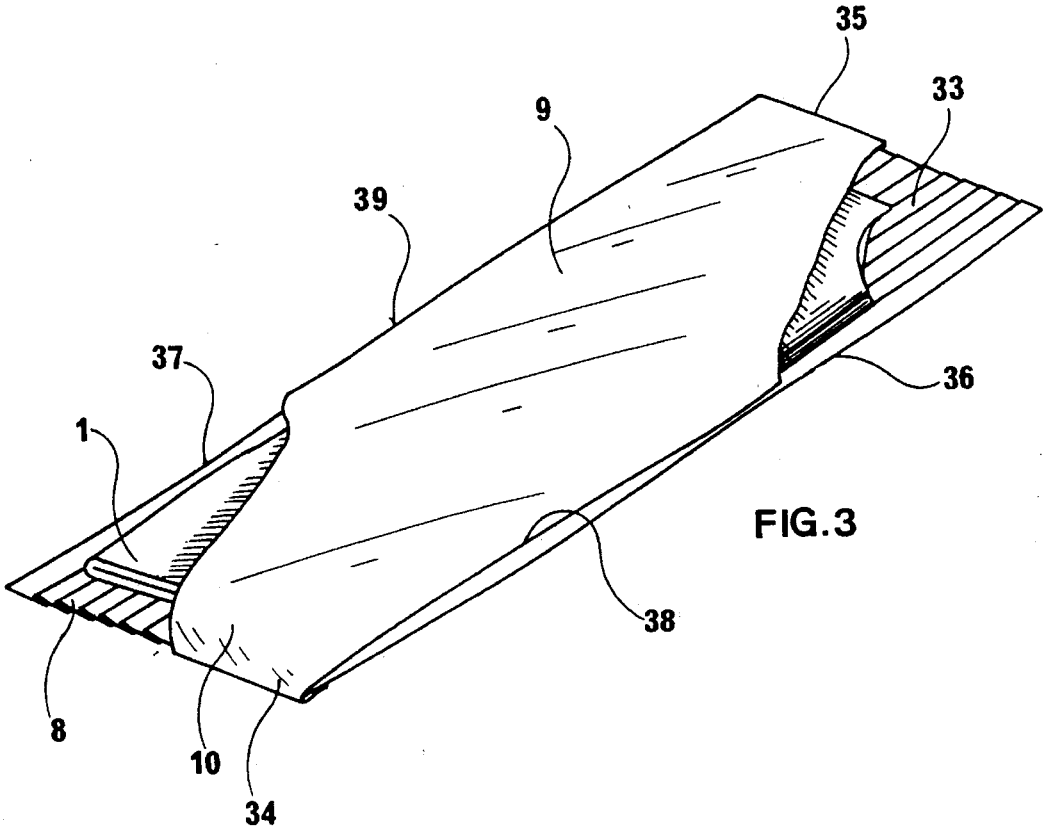
FIG. 3 shows, in a partially exploded perspective view, the elements of a container for products in loose form, with a napkin positioned according to the invention prior to final shaping of the container.
Figure 4:
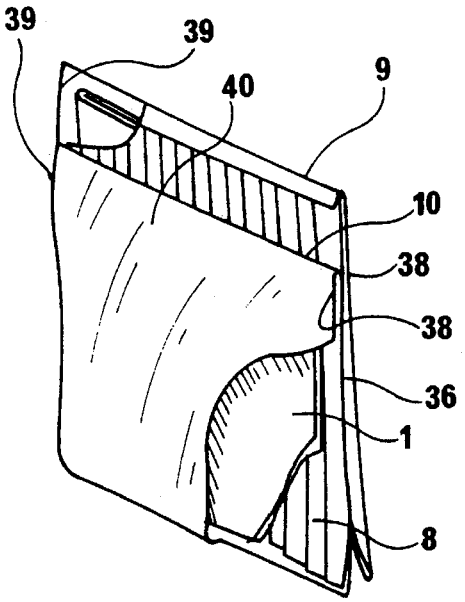
FIG. 4 shows a perspective and partially exploded view of the container in FIG. 3 when finished.

When the container does not comprise a plane portion of sufficient size, and when the container is in particular a folded container such as a bag of chips, as described in the patent application FR-A-2689105, which is made exclusively of folded paper, it is necessary to try to use a zone which does not have to be opened out at the time when the container is put into use; in the case of the bag of chips which is made from folded paper, in accordance with the patent applications FR-A-2689105 and FR-A the said bag of chips is not opened out at the time it is being filled because it serves as a measurer of the quantity of chips supplied; the bag filled with chips is then presented to the consumer in the form not opened out, in order to show to said consumer that the quantity of chips has been correctly measured; before eating the chips, the consumer has the possibility of opening the bag out in order to increase its volume and to ensure its stability. Under these conditions, the napkin 1 (FIG. 3 and FIG. 4) can be placed on the folded portion 33 which is not immediately opened out; it can be covered with a thin sheet 9 which extends beyond all or part of the surface of the napkin 1 and which is fixed to the folded portion so as not to impede the possible opening-out of the folds 8; in order not to impede the opening-out of the folds 8, it is possible in particular to use the attachment zones 10 of the folds 8 at their ends.

The text below will describe, by way of a non-limiting example and preferred embodiment of the invention, a method for continuous production of this type of container, in the case of patent application No. FR-A-2676037 and patent application No. FR-A-2689105.

Figure 6:
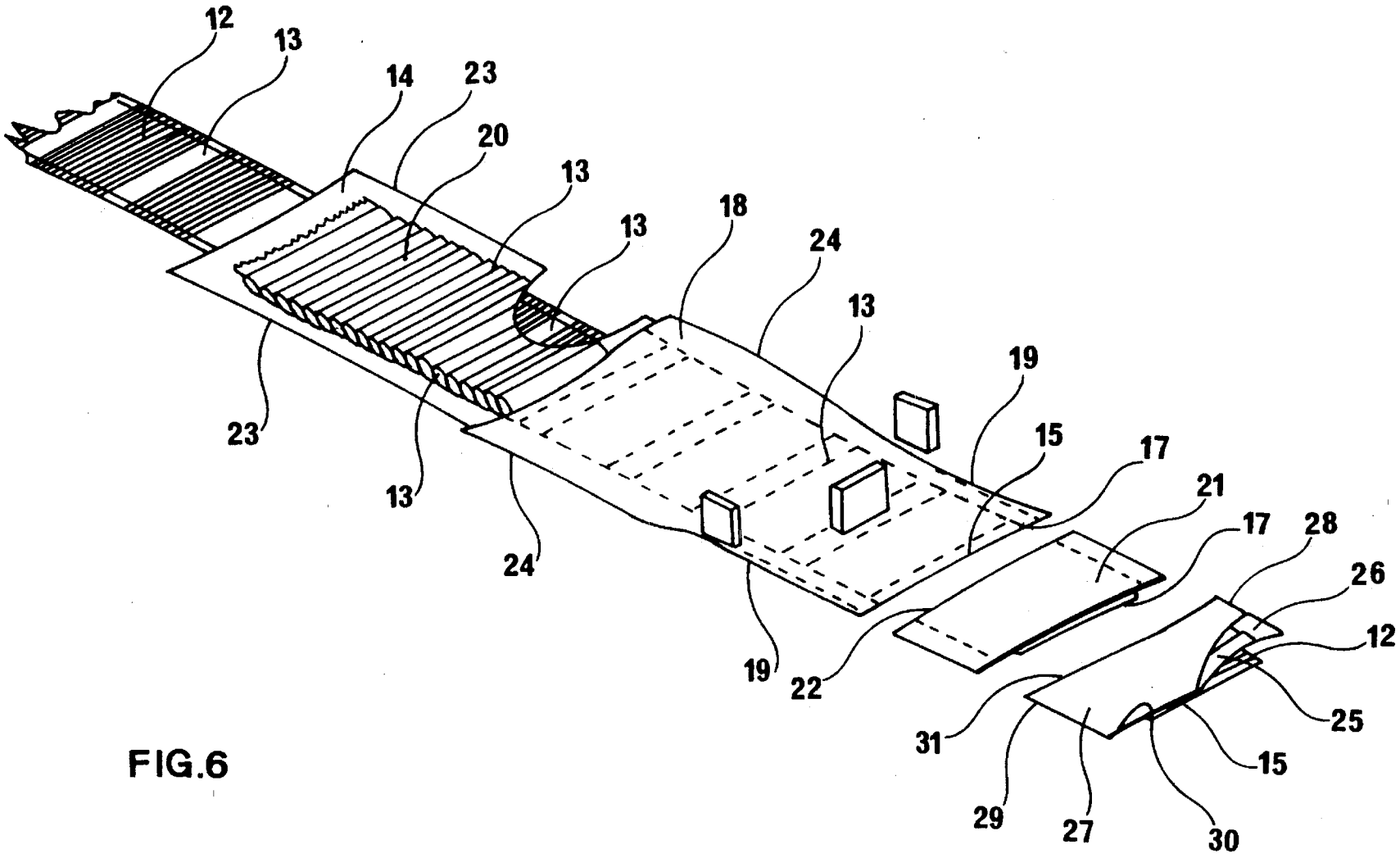
FIG. 6 shows a method for continuous production of the container for a sandwich, comprising a napkin according to the invention.
Figure 7:
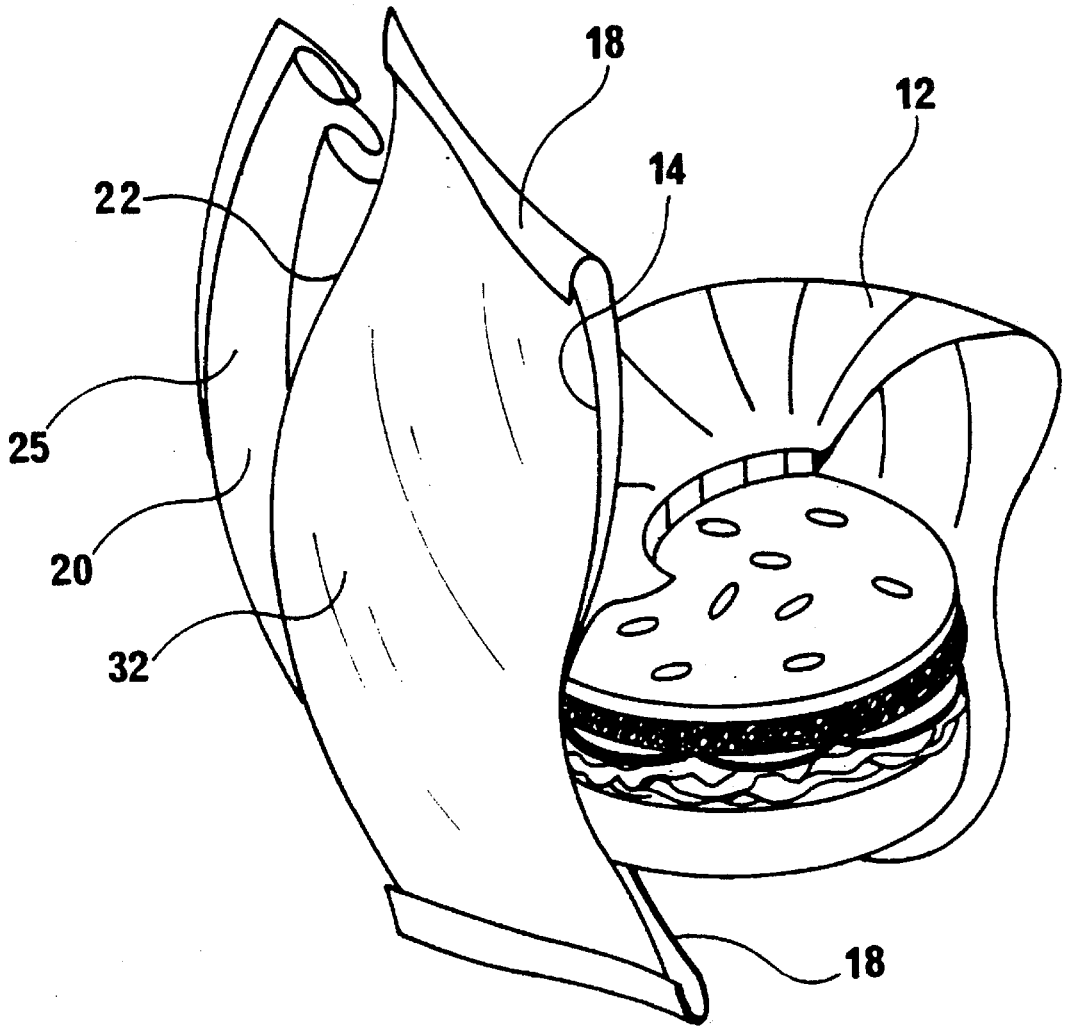
FIG. 7 shows a sandwich covered by a container comprising a napkin according to the invention, which container is half open in order to allow the sandwich to be eaten, and from which the napkin is partially withdrawn.

In the case of patent application FR-A-2676037, the container is obtained by attachment of a flat sheet 6 (FIG. 1) and a folded sheet 11. At the industrial level (FIG. 6), the folded sheet 12 is produced continuously with fold-free zones 13 permitting the separation of the containers without creating waste; a strip consisting of a plane sheet 14 is unrolled on this folded sheet 12, said plane sheet 14 being fixed to the folded sheet 12; it thus gives the container shown in FIG. 1 whose plane sheet 6 is fixed to the folded portion 11, parallel to the folds 16, in a zone 15 situated at the edge of the zones 6 and 11 and which is situated in the zone 13 (FIG. 6) in proximity to the line 17 of separation of the sheets containers 21; these two zones being situated in the fold-free zone 13 (FIG. 6); the assembly formed by the folded sheet 11 (FIG. 3) and the plane sheet 6, constituting the container, is separated simultaneously by a cutting situated in the fold-free zone 13 (FIG. 6) in such a way as to leave the zone of attachment of the plane portion 14 on the folded portion 12 always on the same side in relation to the cutting. The invention consists in adding to the plane strip 14 (FIG. 6) a second strip 18 and in fixing them on their lateral edges 19, while having placed the napkins 20 between them; this assembly is fixed as before to the fold-free zone 13 and is cut in order to separate the containers 21 thus formed; the napkin 20 (FIG. 7) is laterally accessible at least from one side at the level of the edge 22 of the container 21 where the cut 17 has been made for separating the containers 21 (FIG. 6) from each other. The napkins 1 (FIG. 2) are either folded separately and deposited at regular intervals so as not to be cut at the moment of separation 17 (FIG. 6) of the containers 21, or are folded in such a way as to remain in the form of strips 20 placed between the two outer strips 14 and 18 and cut simultaneous to the separation of the containers 21; in this specific case, the precaution must be taken of not damaging the napkin 20 at the moment of the mutual attachment of the strips 14 and 18 and the attachment of the assembly on the folded strip 12, particularly when the attachment is carried out by heat sealing or gluing, there is simultaneous heating of the outer strips 14 and 18 and of the napkin 20 which will adhere to the latter if they comprise a heat-sealing substance on the surface which is in contact with the napkin 20.

More specifically, it is possible, for example, to use a first strip 14 (FIG. 6) comprising a surface covered polyethylene or hot adhesive which serves in particular for attachment, at 15, of the assembly on the folded portion 12 with which the heat-sealing coating is in contact; the second strip 18 is substantially wider than the first 14 and does not have a heat-sealing portion; it is unrolled on the first strip 14, supporting the napkin 20 on the side of the strip 14 not having a heat-sealing coating, and it is fixed to the first strip 14 by means of its lateral edges 24 being turned back in such a way as to cover lateral edges 23 of the first strip 14 in order to bring them into contact with the surface of the first strip 14 coated with heat-sealing substance. The napkin 20 which is placed between the two strips 14 and 18 is not in contact with a heat-sealing surface of the strip 14. The folding of the napkin 20 can be carried out from a reel delivering a strip of paper, corresponding to the width of the napkin when opened out, which is first folded lengthwise in order to bring the width to a size smaller than the width left free by the assembly of the two strips 14 and 18 enclosing the napkin 20 between them. The length of the napkin 20 is obtained by folding crosswise the strip of paper which has already been folded lengthwise; there are numerous means for effecting this folding, and in particular the means already used for forming the folded zone 12 of the container. The napkin 20 is cut at the same time as the finished containers 21 are separated; precautions must be taken to ensure that there is no napkin fold 20 cut at the same time as the separation 17 of the containers 21, since this can create a loss of paper which it is not easy to remove; it is therefore necessary to synchronize the production of the folds of the napkin 20 and that of the folds of the container 12, in such a way as to make their fold-free zones 13 correspond with the zone 17 where the containers 21 are separated.

In these conditions, in the finished container, the napkin 25 is gripped between two rectangular sheets 26 and 27 of paper which are fixed to each other, at two of their opposite ends 28 and 29, and free at the two other ends 30 and 31. This plane portion of the container 21 functions upon use exactly as described in patent application No. FR-A-2676037, and at the same time constitutes a more insulating wall, at the same time improving the heat retention of the container.

When the consumer wishes to eat the hamburger (FIG. 7), he begins by opening the container, this freeing the plane portion 32 and allowing the napkin 25 to be withdrawn.

Figure 5:
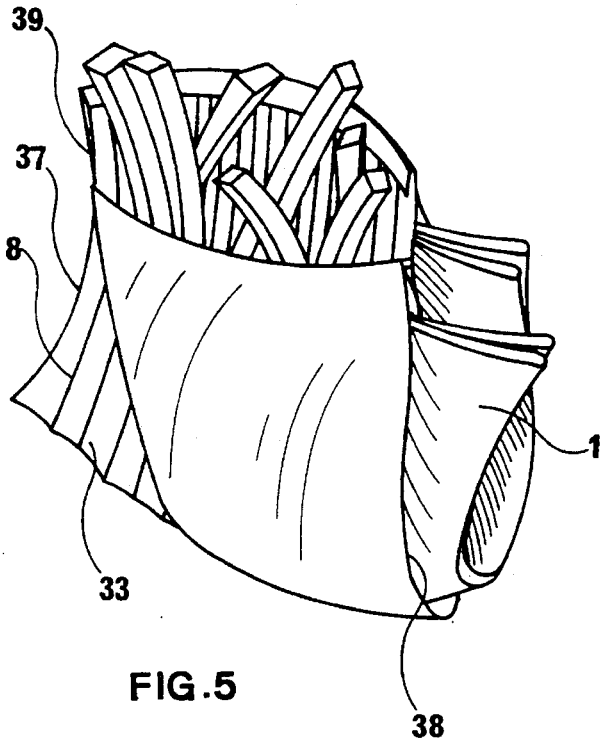
FIG. 5 shows the container in FIG. 4 filled with chips, the napkin being partially withdrawn and the folds being partially opened out.

In the case of patent application No. FR-A-2689105, the bag-is obtained by folding a rectangular sheet coated with a heat-sealing substance on one surface; the folds are fixed to each other at their ends, then this folded assembly is folded in a direction perpendicular to the direction of the folds and welded on the edges parallel to the folds in order to form a pocket. The napkin 1 (FIG. 3), folded as we have already described so as to have a reasonable thickness, is placed on the folded surface 33 which does not contain heat-sealing substance before it is folded perpendicular to the folds 8, and it is covered with a rectangular sheet 9 fixed to the folded portion at the level of the attachment zones of the folds 34 and 35; the assembly is then folded perpendicular to the folds 8 and in such a way that the folded portion 33 is fixed alone on the edges 36 and 37, while the edges 38 and 39 of the sheet 9 (FIG. 3, FIG. 4 and FIG. 5) are free so as to permit the withdrawal of the napkin 1 on the one hand and to permit the extension of the folds 8 of the bag; the bag (FIG. 4) comes with a smooth outer surface 40 covering a napkin 1, making it possible to improve the insulation; when the consumer wishes to withdraw the napkin 1 (FIG. 5) from the bag filled with chips, he can gain access thereto via the lateral edges 38 and 39; he also has access to the edges 37 of the folded portion 33 if he wants to open the container out in order to increase its volume.

Figure 8:
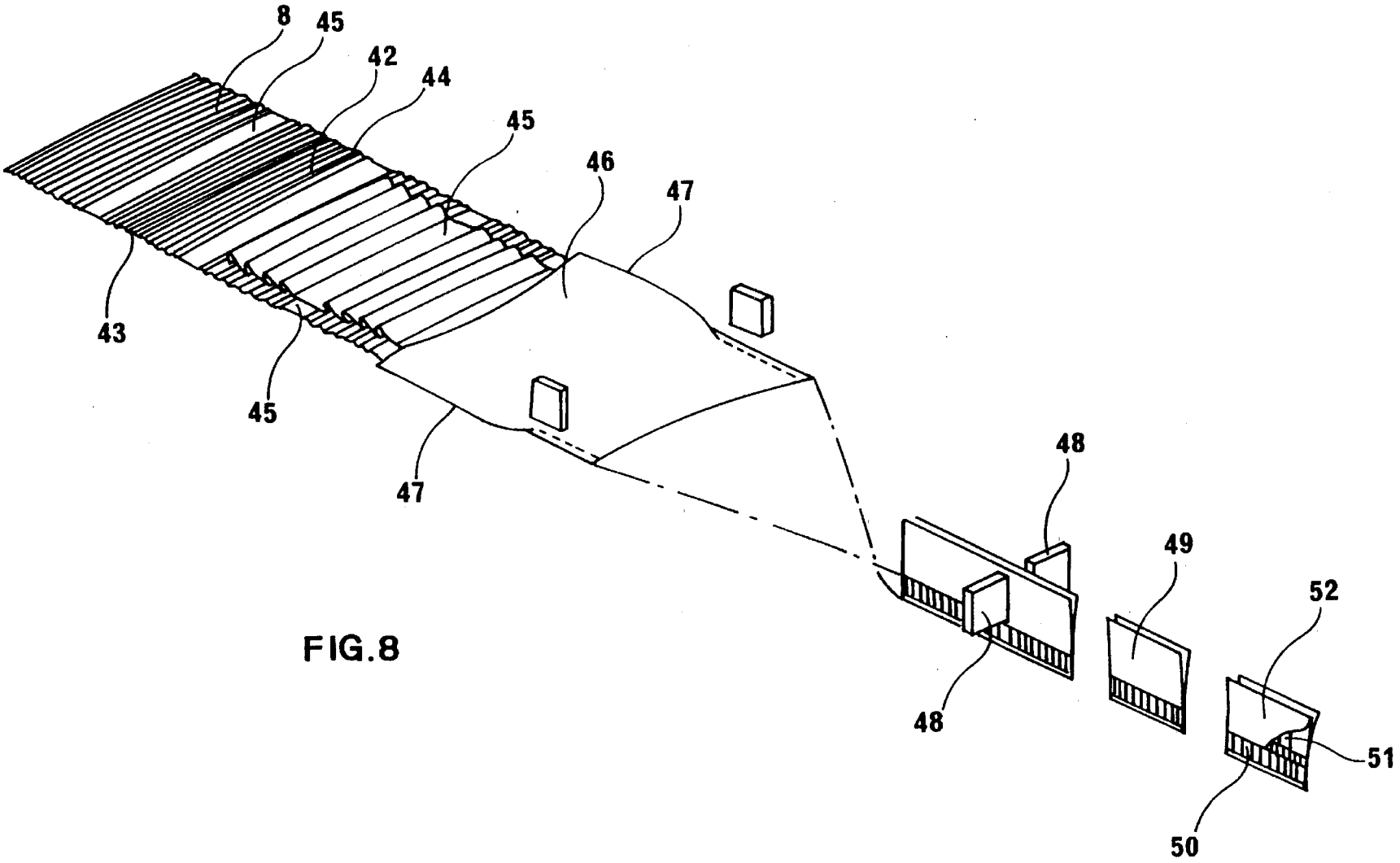
FIG. 8 shows a method for continuous production of a container for products in loose form, comprising a napkin according to the invention.

In a preferred version of the invention, the napkin 41 (FIG. 8) can be folded continuously, as described previously, from a reel, it is deposited on the folded portion 42 which is itself made continuously and whose folds 8 are not definitively fixed at their ends 43 and 44, in such a way that the zones 45, not comprising folds, for effecting the separation of the containers 49, the folded napkin 41 and the folded paper 42, coincide; the napkin 41 is of course deposited continuously on the side opposite the surface, coated with heat-sealing substance, of the folded strip 42 of paper; a strip 46 of paper is then unrolled, not comprising heat-sealing substance, of a width greater than the width of folded paper 42 so as to be able to turn the edges 47 thereof back about the ends 43 and 44 of the folds 8 in such a way that it is possible to fix it on the heat-sealing portion of the folded sheet 42, thereby fixing the ends 43 and 44 of the folds 8 definitively. It remains to fold the assembly in the longitudinal direction, to weld, using the electrodes 48, the fold-free zones 45 over a width sufficient to be able to separate the containers 49 by cutting, at the middle of the weld seam, the assembly comprising the folded sheet 50 constituting the body of the bag, the napkin 51 and the sheet of paper 52 which covers it; as the latter does not comprise heat-sealing substance, it is easy to remove it (FIG. 5) in order to free the napkin 1.

We claim:

1. A folded container for sandwiches which is made from a thin and flexible sheet (2) of rectangular shape, said sheet folded parallel to its width to form folds (16) having lateral ends and adjacent sheet surfaces and said folds being fixed to the adjacent sheet surfaces at the lateral ends in zones, the container having a longitudinal edge (15) characterized by the fact that the container being combined with a disposable folded napkin (1) contained in a pocket (5) having a longitudinal edge and being placed on the said folded container, the pocket being fixed via the longitudinal edges.

2. A folded container according to claim 1, characterized by the fact that the folded napkin (1) is placed on a first thin plane sheet (6) having a perimeter (4) and covered with a second plane thin sheet (3) fixed over at least part of the perimeter (4) of the first sheet (6) to form the pocket, the pocket extending beyond the ends of the folds.

3. A folded container according to either of claims 1 and 2, characterized by the fact that the container has zones (17) of separation and the napkin (20) is folded lengthwise then crosswise with fold-free zones (13) corresponding to the zones (17) of separation of the container (21), the said napkin being placed on a strip (14) having edges (23) and covered with a strip (18) having edges (24), which strips are fixed to each other via the edges (23, 24) and combined with the container.

4. A folded container for products in loose form which is made from a thin and flexible sheet (33) having ends and being folded parallel to its width to form folds (8) and folded again perpendicular to the folds (8) in order to form a bag having an opening, characterized by the fact that the container is combined with a disposable napkin (1) placed on the sheet (33) of the container having small sides and covered with a plane thin sheet (9) having ends (34, 35) turned back and fixed on the small sides of the said container, the opening of the bag being between the small sides.

5. A folded container according to claim 4, characterized by the fact that the container (49) has zones of separation and the napkin (41) is folded lengthwise then crosswise with fold-free zones (45) corresponding to the zones of separation of the container (49), the said napkin being placed on a folded strip (42) having edges (43, 44) and covered with a strip (46) having edges (47) and the strips being connected to each other via the edges (43, 44, 47), the ends of the folds (8) of the sheet (33) being connected to form the said container (49).

* * * * *